US007963238B2

(12) United States Patent
Gardner et al.

(10) Patent No.: US 7,963,238 B2
(45) Date of Patent: Jun. 21, 2011

(54) MAGNETIC HOOP ASSEMBLY

(75) Inventors: Gary Allen Gardner, Dallas, TX (US); Eileen Katherine Roche, Flower Mound, TX (US)

(73) Assignee: Great Notions News, Inc., Dallas, TX (US)

( * ) Notice: Subject to any disclaimer, the term of this patent is extended or adjusted under 35 U.S.C. 154(b) by 405 days.

(21) Appl. No.: 12/192,772

(22) Filed: Aug. 15, 2008

(65) Prior Publication Data

US 2008/0295752 A1 Dec. 4, 2008

Related U.S. Application Data

(63) Continuation-in-part of application No. 11/753,469, filed on May 24, 2007, now Pat. No. 7,610,868.

(51) Int. Cl.
*D05B 39/00* (2006.01)
*D06C 3/08* (2006.01)

(52) U.S. Cl. ..... 112/103

(58) Field of Classification Search ..... 38/102.2, 38/102.91; 112/103, 470.14, 470.18, 475.18
See application file for complete search history.

(56) References Cited

U.S. PATENT DOCUMENTS

| | | | | |
|---|---|---|---|---|
| 4,236,331 | A | 12/1980 | Mattson | |
| 4,639,964 | A | 2/1987 | Binder | |
| 4,644,639 | A | 2/1987 | Atteberry et al. | |
| 4,763,586 | A | 8/1988 | Takenoya et al. | |
| 4,834,006 | A | 5/1989 | Goto | |
| 5,101,746 | A | 4/1992 | Frye | |
| 5,138,960 | A | 8/1992 | Inteso | |
| 5,144,899 | A * | 9/1992 | Allen | 112/103 |
| 5,353,725 | A | 10/1994 | Sakakibara | |
| 5,546,877 | A | 8/1996 | Moore | |
| 5,666,895 | A | 9/1997 | Gehres et al. | |
| 5,842,430 | A | 12/1998 | Mack | |
| 5,915,315 | A | 6/1999 | Bentz | |
| 5,970,895 | A * | 10/1999 | Mack | 112/103 |
| 6,112,682 | A | 9/2000 | Van Bruggen et al. | |
| 6,240,863 | B1 | 6/2001 | Vickroy et al. | |
| 6,708,632 | B2 | 3/2004 | Shibata | |
| 6,957,614 | B1 | 10/2005 | Buck | |
| 7,194,967 | B2 | 3/2007 | Bowlus | |
| 7,258,071 | B2 | 8/2007 | Shoji | |
| 7,357,088 | B1 | 4/2008 | Bowlus | |
| 7,607,399 | B2 | 10/2009 | Mack et al. | |
| 7,610,868 | B2 | 11/2009 | Gardner | |
| 2004/0163295 | A1 * | 8/2004 | Fontana et al. | 40/617 |
| 2008/0276849 | A1 | 11/2008 | Mack et al. | |

FOREIGN PATENT DOCUMENTS

| | | | |
|---|---|---|---|
| EP | 0466269 A2 | | 8/1991 |
| JP | 03130456 | * | 6/1991 |
| JP | 09031825 | | 2/1997 |
| JP | 11181666 | | 7/1999 |
| JP | 2002078996 | * | 3/2002 |
| JP | 2005146460 | | 6/2005 |
| JP | 6328230 | | 8/2008 |

* cited by examiner

*Primary Examiner* — Ismael Izaguirre
(74) *Attorney, Agent, or Firm* — Afghani Law Firm; Kevin Afghani

(57) ABSTRACT

A placement holder for an embroiderable comprising a magnetic hoop assembly for use in an embroidery machine. The magnetic hoop assembly includes a first hoop comprising a magnetic material and a second hoop comprising a quantity of metal sufficient for the first hoop to be attracted to the second hoop. The magnetic attraction between the first hoop and the second hoop enables the embroiderable to be held in place between the first hoop and the second hoop for embroidery. An adapter is attached to either the first hoop or second hoop. One end of the adapter is attached to the first hoop or second hoop, and the other end of the adapter attaches to an attachment mechanism on a pantograph on the embroidery machine.

20 Claims, 11 Drawing Sheets

MAGNETIC HOOP ASSEMBLY

This application is a continuation-in-part of application Ser. No. 11/753,469, filed May 24, 2007, status pending.

BACKGROUND OF THE INVENTION

1. Technical Field

The present invention is directed generally toward sewing and embroidery. In particular, the present invention relates to an improved method and system for positioning and holding items for embroidery.

2. Description of Related Art

An item to be embroidered, such as a shirt, cap, or belt, is known as an embroiderable. The embroiderable must be correctly positioned and held in place in an embroidery machine so that a design may be embroidered in the desired position on the material of the embroiderable. Currently, the embroiderable is held in place by using one of an embroidery hoop, a frame and adhesive, a clamping device, or a metal plate inside an embroidery hoop with a window and magnets. Each of these means for holding and positioning the embroiderable has disadvantages.

To use a frame and adhesive, an embroidery machine operator attaches a frame to the embroidery machine, applies adhesive to backing material, attaches the embroiderable to the backing material, and then places the backing material with the attached embroiderable in the frame. The frame and adhesive are typically used for small items, such as patches, which do not fit into a frame. One disadvantage of using the frame and adhesive is that the adhesive is messy and can gum up the embroidery machine, or the embroiderable.

To use an embroidery hoop, an embroidery machine operator snaps a top hoop and a bottom hoop together with the embroiderable and backing in between the two hoops. Snapping together and pulling apart the two hoops may be difficult for the operator, especially if the embroiderable is made from a thick material, and if the operator has less than average strength. In addition, some embroiderables, such as belts, check book covers, doilies, and collars, may be difficult to position properly using an embroidery hoop. Also, snapping together the hoops may leave burn marks on delicate fabrics, such as silk or velvet.

A clamping device uses two plates to clamp the embroiderable in place. A disadvantage of the clamping device is that many delicate materials, such as velvet and silk, get burn marks or fabric degradation when the clamping device is used. Another disadvantage of the clamping device is that one side of the clamping device is closed, so that certain types of items cannot be embroidered using the clamping device. For example, a long item, such as a laundry bag or pant leg, cannot be embroidered using the clamping device because the closed side of the clamping device prevents the operator from pushing the embroiderable far enough through the clamping device.

Another approach to holding an embroiderable in an embroidery machine is to use a metal plate inside a conventional embroidery hoop and magnets to hold the embroiderable in place, as described in U.S. Published Patent Application No. 2006/0272565, entitled "Embroidery Patch Placement Holder". However, using the metal plate with a conventional embroidery hoop still requires the operator to snap together and pull apart the two hoops, which may be physically challenging for operators with less than average strength, such as the disabled or elderly. Moreover, the operator faces increased complexity because the metal plate and magnets are used in addition to the conventional two hoops, adding more steps to the embroidery process.

Thus, each of the current means for holding and positioning an embroiderable for embroidery has disadvantages. Therefore, it would be advantageous to have an improved method and system for positioning and holding items for embroidery.

SUMMARY OF THE INVENTION

The illustrative embodiments described herein provide a placement holder for an embroiderable. The placement holder comprises a magnetic hoop assembly for use in an embroidery machine. The magnetic hoop assembly includes a first hoop comprising a magnetic material and a second hoop comprising a quantity of metal sufficient for the first hoop to be attracted to the second hoop. The magnetic attraction between the first hoop and the second hoop enables the embroiderable to be held in place between the first hoop and the second hoop for embroidery. An adapter is attached to either the first hoop or second hoop. One end of the adapter is attached to the first hoop or second hoop, and the other end of the adapter attaches to an attachment mechanism on a pantograph on the embroidery machine.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

The description of the preferred embodiment of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated.

An item to be embroidered, such as a shirt, cap, or belt, is known as an embroiderable. An embroiderable may be made from a variety of materials, such as plastic, cotton, silk, velvet, polyester, and linen, among others. The embroiderable must be correctly positioned and held in place in an embroidery machine so that the design may be embroidered in the desired position on the material of the embroiderable. Currently, the embroiderable is held in place by using one of a frame and adhesive, a clamping device, an embroidery hoop, or a metal plate with the embroidery hoop. Each of these means for holding and positioning the embroiderable has disadvantages.

Figure 1A:
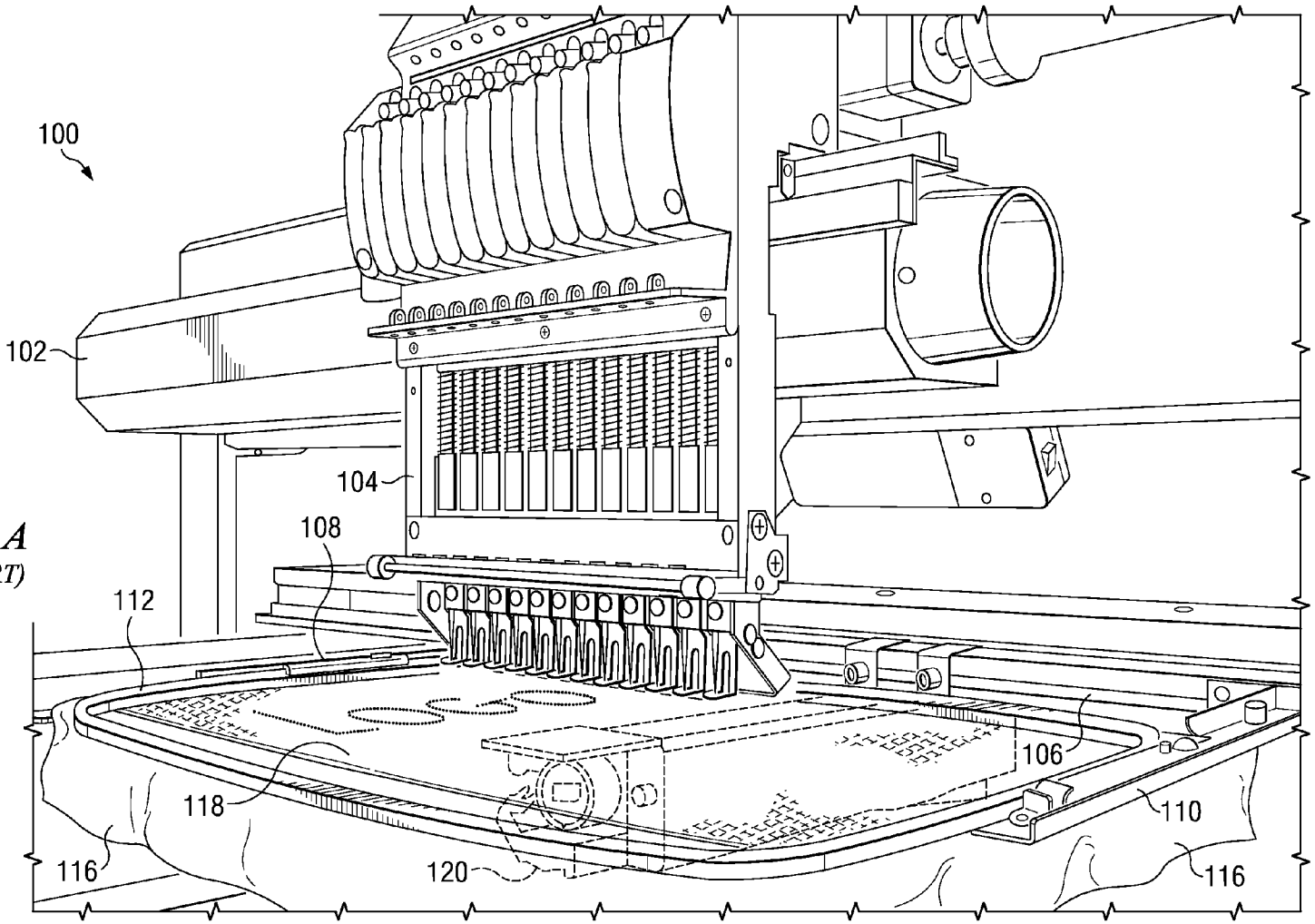
FIG. 1A (PRIOR ART)
FIG. 1A illustrates a known means for holding and positioning an embroiderable comprising a frame attached to an embroidery machine.

FIG. 1A illustrates a known means for holding and positioning an embroiderable comprising a frame attached to an embroidery machine. A frame attached to an embroidery machine 100 shows how a frame and adhesive are used to hold and position an embroiderable in an embroidery machine. In FIG. 1A, the embroidery machine has a bridge 102. Attached to bridge 102 is head 104 which contains the needles and threads used to embroider the embroiderable. Bridge 102 sits over pantograph 106. Pantograph 106 is a component in the embroidery machine which moves along the x-y axis and precisely positions the embroiderable under head 104 for the pattern to be embroidered. Attached to pantograph 106 are two arms, arm 108 and arm 110. Frame 112 is attached to arms 108 and 110 of pantograph 106 in embroidery device 100. An adhesive (not shown) is applied to backing 116. Embroiderable 118 is stuck on to backing 116 using the adhesive. Backing 116, containing embroiderable 118, is then placed in frame 112 to position and hold embroiderable 118 for embroidery. Typically, frame 112 and the adhesive are used for a small embroiderable, such as a patch, which is too small to be placed directly in a hoop.

However, using an adhesive to hold and position the embroiderable is messy because the adhesive may gum up the embroidery machine or the embroiderable. In addition, some adhesives are sprayed on, subjecting the operator to breathing in the fumes of the spray adhesive and any solvent used to clean up the overspray from the adhesive. Once backing 116 and embroiderable 118 are placed in frame 112, head 104 performs embroidery on embroiderable 118.

Figure 1B:
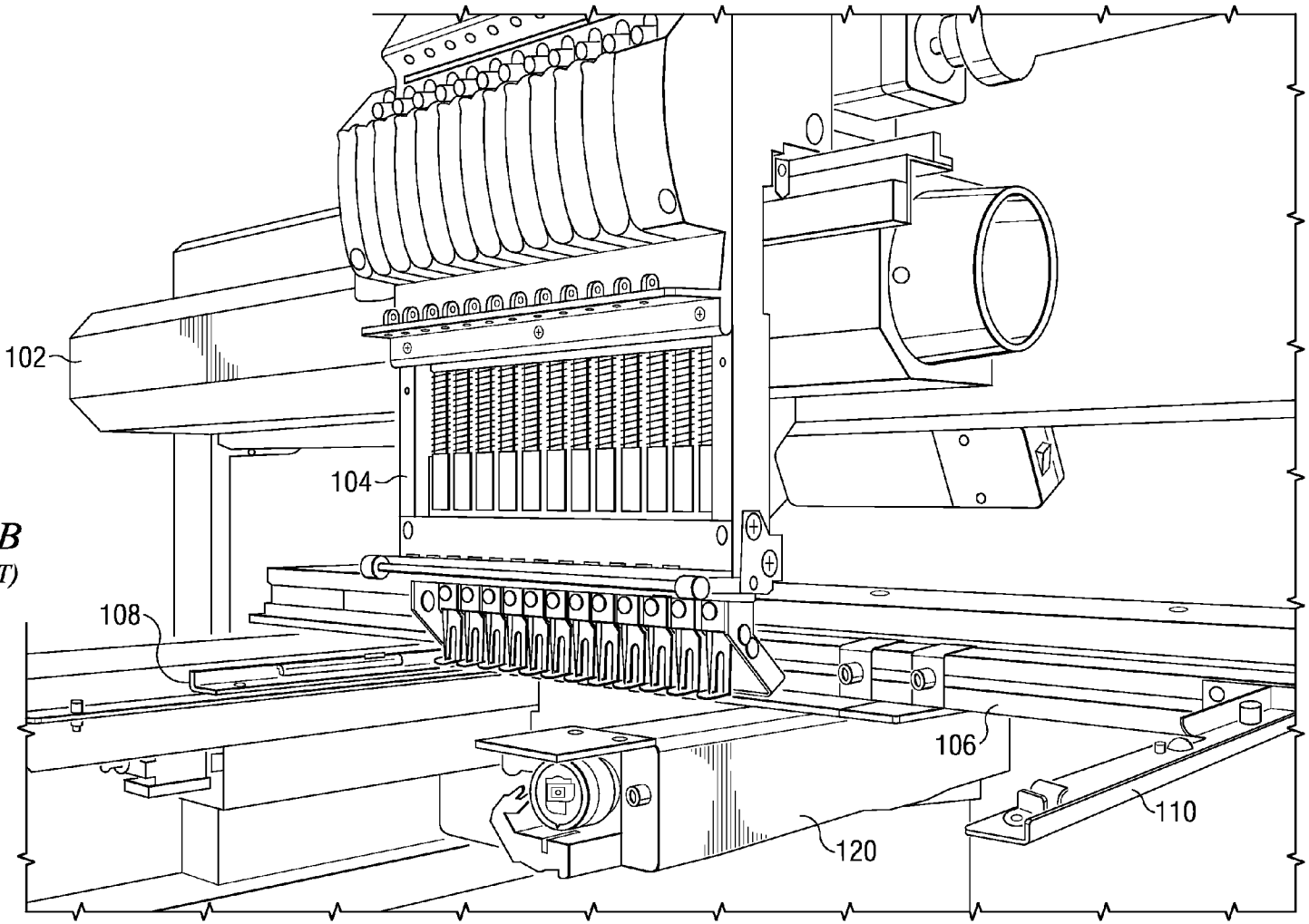
FIG. 1B (PRIOR ART)
FIG. 1B illustrates a known embroidery machine.

FIG. 1B illustrates a known embroidery machine. In FIG. 1B, sewing arm 120 is attached to pantograph 106 between arms 108-110. Pantograph 106 positions an embroiderable (not shown) under a head containing needles, such as head 104, and over sewing arm 120. Sewing arm 120 is used to hold a stitch in place as the needles in head 104 stitch a pattern on the embroiderable (not shown).

Figure 2:
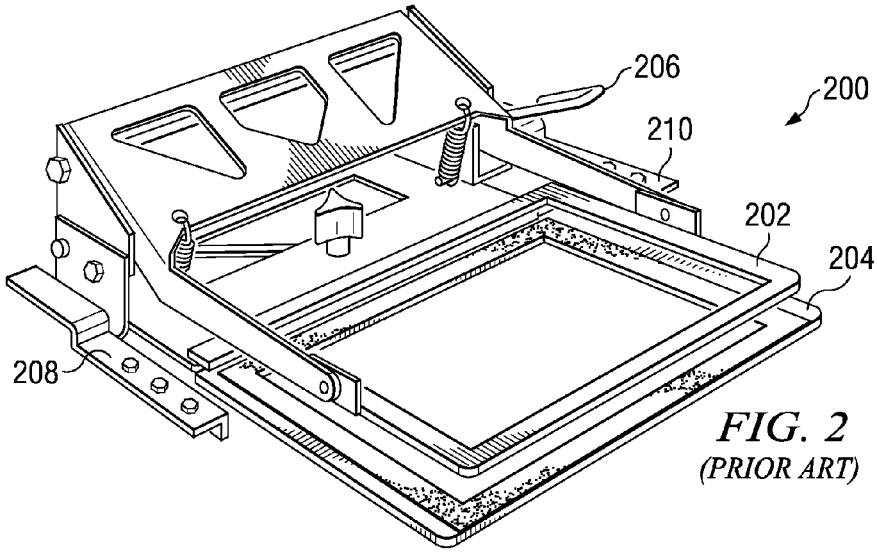
FIG. 2 (PRIOR ART)
FIG. 2 illustrates a known means for holding and positioning an embroiderable comprising a clamping device for embroidery.

FIG. 2 illustrates a known means for holding and positioning an embroiderable comprising a clamping device for embroidery. Clamping device uses two plates, plate 202 and plate 204, to clamp the embroiderable in place. Initially, plates 202 and 204 are open, as shown in FIG. 2. The embroiderable is placed in between plates 202 and 204, and lever 206 is used to close plates 202 and 204 together to hold and position the embroiderable for embroidery. Clamping device for embroidery 200 is attached to the embroidery machine using flange 208 and flange 210 by sliding flanges 208 and 210 onto the arms of the embroidery machine, such as arms 108 and 110 in FIGS. 1A and 1B. Each flange engages with an arm on the embroidery machine. One disadvantage of using the clamping device for embroidery is that many delicate materials, such as velvet and silk, get burn marks or fabric degradation when the clamping device is used because of the pressure placed on the embroiderable when plates 202 and 204 are closed together.

Figure 3A:
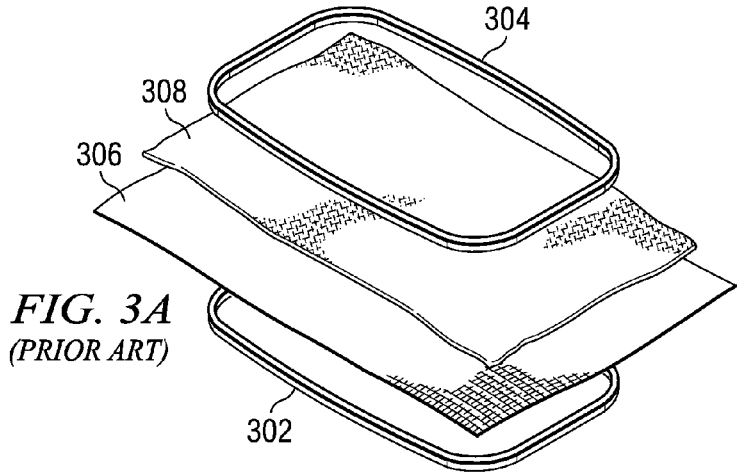
FIG. 3A (PRIOR ART)
FIG. 3A illustrates a known means for holding and positioning an embroiderable comprising an embroidery hoop with backing and embroiderable.

FIG. 3A illustrates a known means for holding and positioning an embroiderable comprising an embroidery hoop with backing and embroiderable. Embroidery hoop with backing and embroiderable shows how a conventional embroidery hoop is used to hold and position an embroiderable. The embroidery hoop has two parts, bottom hoop 302 and top hoop 304. The operator of an embroidery machine places backing 306 on top of bottom hoop 302, places embroiderable 308 over backing 306, and places top hoop 304 on top of embroiderable 308. Backing 306 is a special type of material used to assist in embroidering the embroiderable. FIG. 3A depicts hoops 302 and 304, backing 306, and material 308 as overlapping each other in order to clearly show each component, but in practice, each component is placed on top of each other with no overlap.

After the embroidery machine operator lays backing 306, embroiderable 308 and hoop top 304 on top of bottom hoop 302, the embroidery machine operator snaps hoops 302 and 304 together to create a hoop assembly. The hoop assembly, comprising hoops 302 and 304, embroiderable 308, and backing 306, is then attached to the embroidery machine so that embroiderable 308 may be embroidered. The hoop assembly may be attached to the embroidery machine in a variety of ways. For example, the hoop assembly may be attached to the embroidery machine by sliding hoops 302 and 304 into two arms connected to the embroidery machine, such as arms 108 and 110 in FIGS. 1A and 1B.

One disadvantage of the embroidery hoop is that correctly positioning embroiderable 308 within the hoop is difficult, and typically involves trial and error. If embroiderable 308 is not properly positioned, the operator must pull apart hoops 302 and 304, reposition embroiderable 308, and snap hoops 302 and 304 back together. Depending on the thickness of the material of embroiderable 308, snapping together and pulling apart hoops 302 and 304 may be difficult for the operator. If the material of the embroiderable is very thick, a considerable amount of pressure must be exerted to snap hoops 302 and 304 together. Exerting sufficient pressure to snap hoops 302 and 304 together may be difficult for an operator with less than average strength, such as, for example, an older person, someone with a disability, or a child. In addition, some embroiderables are thick enough to prevent an operator from snapping the two hoops together, and therefore the two hoops may not be used for such embroiderables.

Figure 3B:
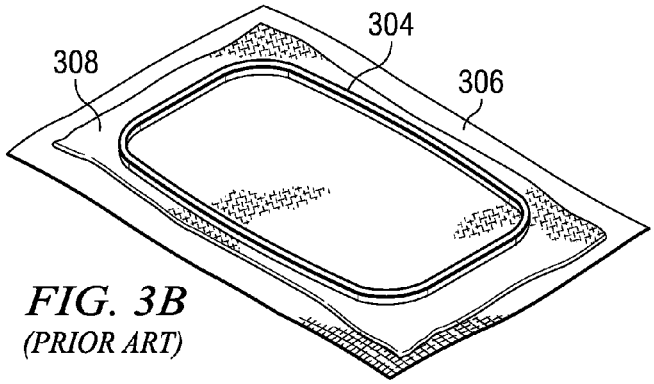
FIG. 3B (PRIOR ART)
FIG. 3B illustrates a known means for holding and positioning an embroiderable comprising an embroidery hoop with backing and material snapped together.

FIG. 3B illustrates a known means for holding and positioning an embroiderable comprising an embroidery hoop with backing and material snapped together. In FIG. 3B, bottom hoop (not shown) and top hoop 304 are snapped together with backing 306 and embroiderable 308 in between. Specifically, backing 306 placed on top of bottom hoop (not shown), embroiderable 308 placed on top of backing 306, top hoop 304 placed on top of embroiderable 308, and bottom hoop (not shown) and top hoop 304 are snapped together. In FIG. 3B, the bottom hoop is not visible because it is located beneath top hoop 304, backing 306, and embroiderable 308.

Figure 4:
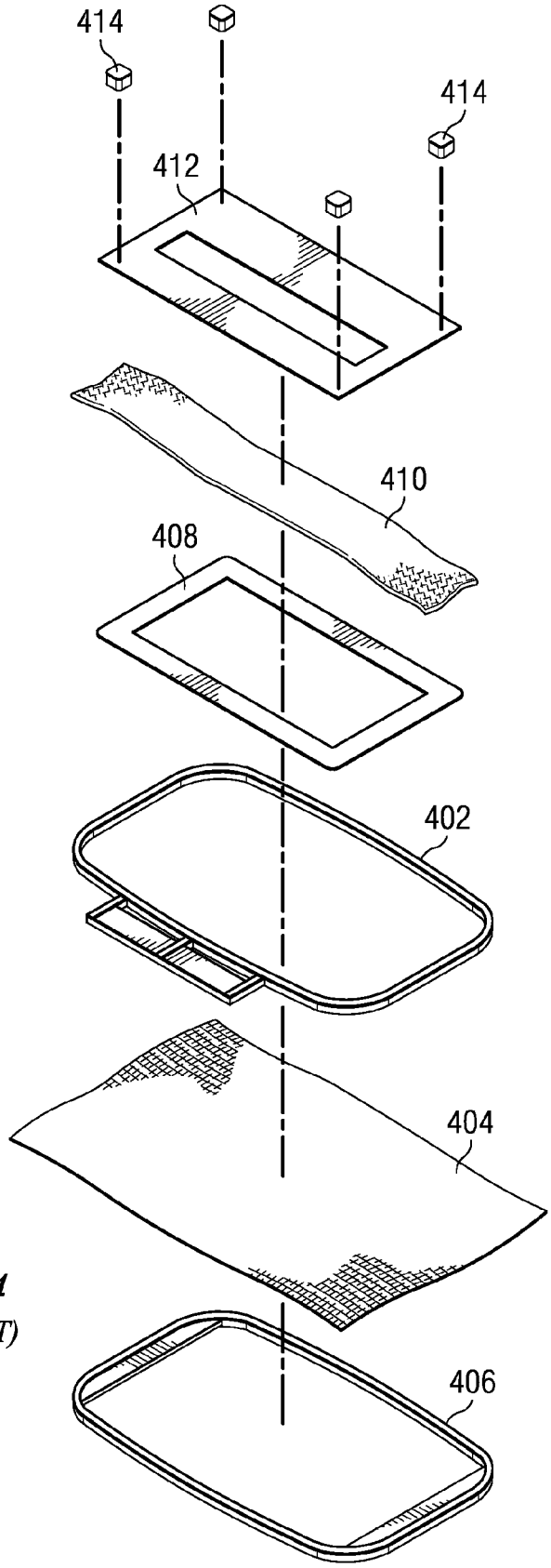
FIG. 4 (PRIOR ART)
FIG. 4 illustrates a known means for holding and positioning an embroiderable comprising a hoop with a metal plate and window.

FIG. 4 illustrates a known means for holding and positioning an embroiderable comprising a hoop with a metal plate and window. Hoop with metal plate and positioning device uses a conventional hoop, such as the one shown in FIGS. 3A-3B. Currently, hoop with metal plate and positioning device is used only for holding and positioning one specific type of embroiderable, such as a patch.

Top hoop 402 is a top hoop, such as top hoop 304 in FIG. 3A, and bottom hoop 406 is a bottom hoop, such as bottom hoop 302 in FIG. 3A. The operator of the embroidery machine places backing 404 on top of bottom hoop 406, places top hoop 402 on top of backing 404, and snaps bottom hoop 406 and top hoop 402 together to create a hoop assembly. Backing 404 is backing used to assist in the embroidery, such as backing 306 in FIG. 3A.

After creating the hoop assembly, the embroidery machine operator places metal plate 408 inside top hoop 402, places embroiderable 410 on top of metal plate 408, places positioning device 412 on top of embroiderable 410, and places magnets 414 on top of positioning device 412. Positioning device 412 contains a window so that embroiderable 410 may be accurately positioned on the hoop assembly. Magnets 414 may include two or more magnets. When using a rectangular metal plate, such as metal plate 408, four magnets are typically used, with one magnet on each corner of positioning device 412. The natural attraction of magnets 414 to metal plate 408 is used to keep embroiderable 410 and positioning device 412 in place on the hoop assembly. The window on positioning device 412 allows embroiderable 410 to be quickly positioned without adhesive or clamping. The hoop assembly, along with embroiderable 410, positioning device 412, and magnets 414 are attached to the embroidery machine by attaching bottom hoop 406 and top hoop 402 to the two arms of the embroidery machine, such as arms 108 and 110 in FIGS. 1A and 1B.

However, there are several disadvantages to using the metal plate and magnets. The two hoops must still be snapped together with the backing between them because a conventional hoop is still being used. Depending on the thickness of the backing, an embroidery machine operator may find snapping the two hoops together to be physically challenging. Also, changing the embroiderable still requires the step of snapping and pulling apart the two hoops. In addition, backing is wasted because the backing must be larger than the size of the two hoops. Moreover, the operator faces increased complexity when embroidering because the metal plate and magnets are used in addition to the conventional two hoops, adding more components and steps to the embroidery process.

The illustrative embodiments recognize that each one of the conventional means for positioning and holding an embroiderable in an embroidery machine have disadvantages. The illustrative embodiments recognize that the two hoops may be difficult to snap together for some embroiderables, and cannot be used for very thick embroiderables. The illustrative embodiments recognize that the frame and adhesive are messy to use, and the adhesive may gum up the embroidery machine. The illustrative embodiments recognize that the clamping device may leave burn marks on delicate fabrics, and that the clamping device cannot be used for very long items because one side of the clamping device is closed. The illustrative embodiments also recognize that a metal plate inside an embroidery hoop with a window and magnets still requires the operator to snap the two hoops together, and recognize that the metal plate, window, and magnets create additional complexity for the operator.

The illustrative embodiments described herein provide an improved placement holder for an embroiderable. The placement holder comprises a metallic hoop for use in an embroidery machine. The metallic hoop comprises a quantity of metal sufficient for a magnet to be attracted to the metallic hoop. A backing and the embroiderable are placed on top of the metallic hoop for embroidery. An adapter is attached to the metallic hoop. One end of the adapter is attached to the metallic hoop, and the other end of the adapter attaches to an attachment mechanism on a pantograph on the embroidery machine.

Figure 5:
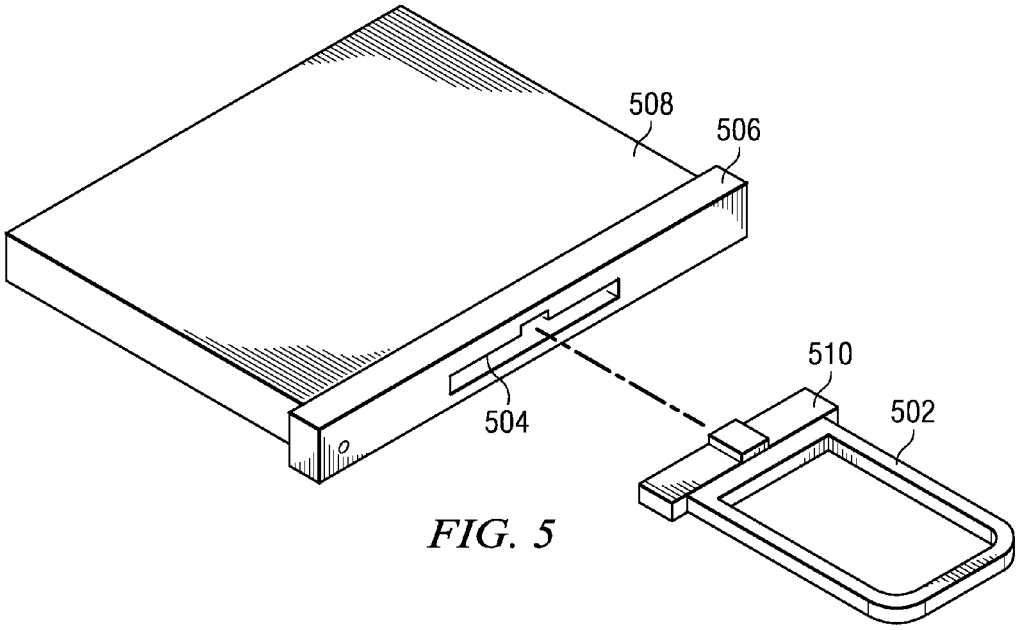
FIG. 5 illustrates a metallic hoop for embroidery in accordance with the illustrative embodiments.

FIG. 5 illustrates a metallic hoop for embroidery in accordance with the illustrative embodiments. In the metallic hoop for embroidery, hoop 502 is a single hoop containing a metal substance. Those versed in the art will appreciate that hoop 502 may be created in a number of different ways. For example, in one embodiment, hoop 502 may be made entirely from metal. Alternately, in another embodiment, hoop 502 may be created using both metallic and non-metallic substances. For example, hoop 502 may be created by bonding a metal plate shaped like a hoop on top of a hoop made of plastic or fiberglass. Thus, while hoop may be created by bonding different substances together, the primary characteristics of hoop 502 are that it is a single hoop containing a metal substance. Hoop 502 contains sufficient metal so that magnets, such as magnets 414 in FIG. 4, have an attraction to hoop 502. In FIG. 5, hoop 502 is shown as rectangular in shape with rounded corners. Those versed in the art will appreciate that hoop 502 may be created in a variety of shapes and sizes for use with different types of embroiderables.

Because of the wide variety of embroiderables, specialized accessories are often attached to an embroidery machine in order to position and hold the embroiderable in place. For example, to embroider a cap, a cap frame driver accessory is usually attached to an embroidery machine. Therefore, a typical embroidery machine provides an attachment mechanism, such as attachment mechanism 504 for attaching accessories. Attachment mechanism 504 is part of backrail 506. Backrail 506 is part of pantograph 508. Pantograph 508 is a pantograph in an embroidery machine, such as pantograph 106 in FIGS. 1A and 1B. Backrail 506 is the portion of the pantograph below the embroidery head, such as head 104 in FIGS. 1A and 1B. Attachment mechanism 504 is used to attach an accessory, such as the cap frame driver, to pantograph 508 on the embroidery machine.

Attachment mechanism 504 may vary from one embroidery machine to another, because of a variety of factors, including the manufacturer of the embroidery machine or the size of the embroidery machine. Adapter 510 is used to adapt hoop 502 for use with different attachment mechanisms, such as attachment mechanism 504. Those versed in the art will appreciate that adapter 510 is designed to accommodate one or more of the various attachment mechanisms available so that hoop 502 may be used with any type or size of embroidery machine. Adapter 510 varies depending on the type of attachment mechanism 504 on backrail 506 of the embroidery machine. For example, if attachment mechanism 504 is a "T" shaped slot in backrail 506, adapter 510 may contain a "T" shape which slides into the slot in backrail 506. Alternately, adapter 510 may have two flanges, such as flanges 208 and 210 in FIG. 2, for attaching hoop 502 to two arms, such as arms 108 and 110 in FIGS. 1A and 1B, of an embroidery machine.

Figure 6:
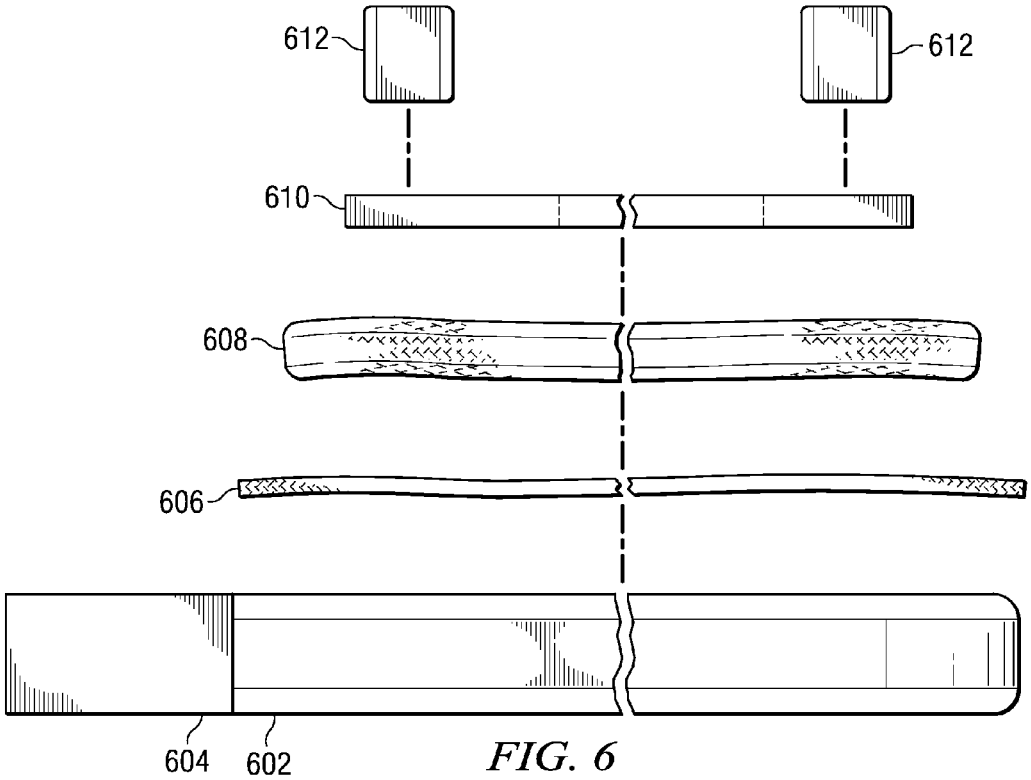
FIG. 6 illustrates preparing an embroiderable using a metallic hoop in accordance with the illustrative embodiments.

FIG. 6 illustrates preparing an embroiderable using a metallic hoop in accordance with the illustrative embodiments. In preparing an embroiderable using a metallic hoop, hoop 602 is a single hoop containing a metal substance, such as hoop 502 in FIG. 5. Adapter 604 adapts hoop 602 for use with a specific embroidery machine by allowing adapter 604 to attach to the backrail of a pantograph using an attachment mechanism, such as attachment mechanism 504 in FIG. 5. The operator of the embroidery machine places backing 606 on top of hoop 602. The operator then places embroiderable 608 on top of backing 606, and positioning device 610 on top of embroiderable 608. Positioning device 610 is a positioning device, such as positioning device 412 in FIG. 4. Positioning device 610 contains a window which allows the operator to appropriately position embroiderable 608 for embroidery. Magnets 612 are one or more magnets, such as magnets 414 in FIG. 4. Magnets 612 have an attraction to the metal in hoop 602, and the attraction holds positioning device 610, embroiderable 608, and backing 606 in place on hoop 602. Magnets 612 allow the operator to quickly and easily position embroiderable 608 for embroidery using positioning device 610.

Those versed in the art will appreciate that magnets 612 may be combined with positioning device 610. For example, positioning device may be manufactured in such a way that a portion of positioning device 610, such as, for example, each corner of positioning device 610, contains a magnet. Alternately, positioning device 610 may be made from a magnetic material.

As previously mentioned, adapter 510 in FIG. 5 is used to attach hoop 502 to attachment mechanism 504 on backrail 506 of pantograph 508. Attachment mechanism 504 may vary from one embroidery machine to another embroidery machine because of factors, such as, for example, the manufacturer of the embroidery machine. Adapter 510 is designed to attach to a specific type of attachment mechanism 504.

Figure 7:
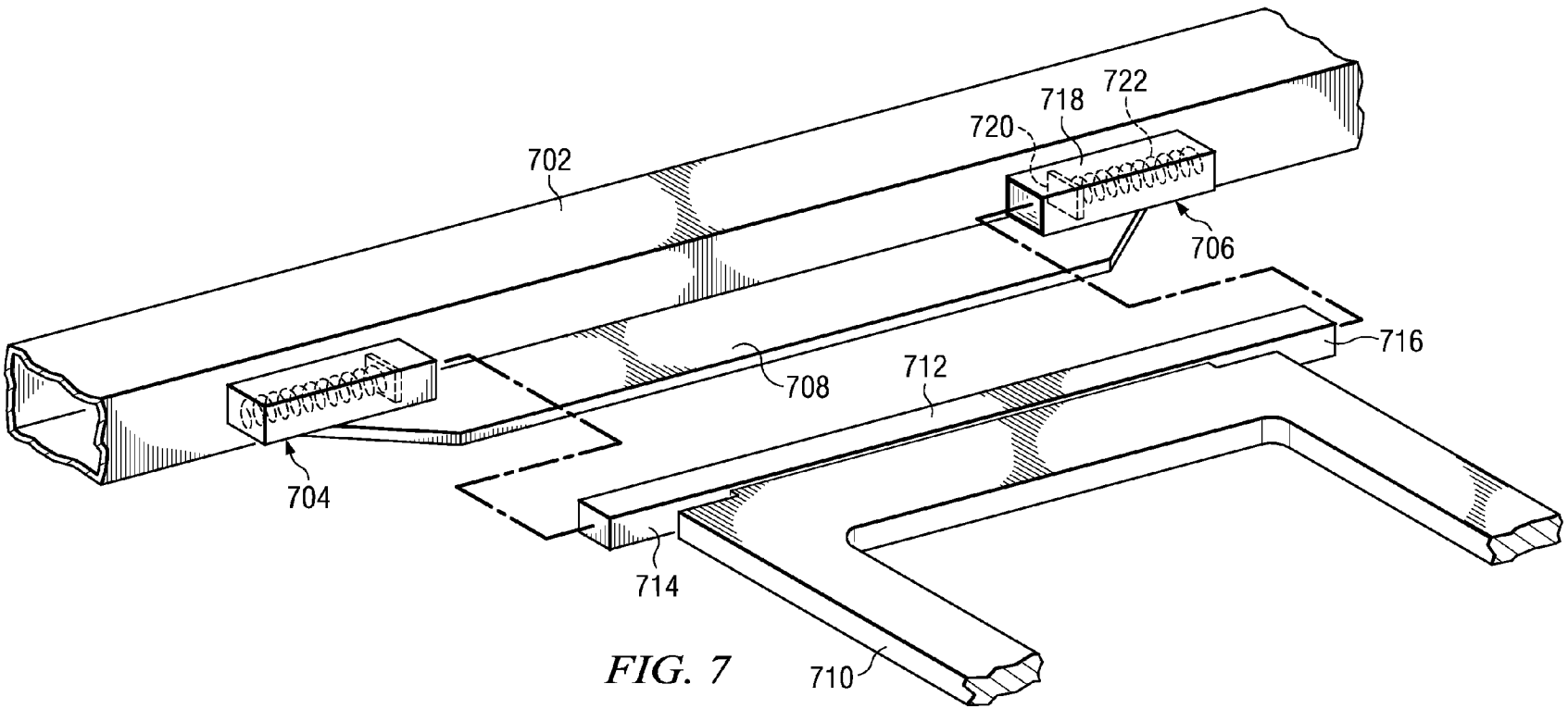
FIG. 7 illustrates an adapter and attachment mechanism for attaching a metallic hoop in accordance with the illustrative embodiments.

FIG. 7 illustrates an adapter and attachment mechanism for attaching a metallic hoop in accordance with an illustrative embodiment. Adapter and attachment mechanism for attaching a metallic hoop illustrates how a metallic hoop may be attached to an embroidery machine. Backrail 702 is a backrail, such as backrail 506 in FIG. 5. On backrail 702 is an attachment mechanism, such as attachment mechanism 504 in FIG. 5, with three components; indentations 704 and 706, and lip 708. Hoop 710 is a hoop, such as hoop 502 in FIG. 5. Hoop 710 is attached to backrail 702 using adapter 712. Adapter 712 has two horizontal protrusions, protrusions 714 and 716, on either end.

The operator attaches hoop 710 to backrail 702 by sliding one protrusion into a first indentation, and then sliding the other protrusion into the second indentation. For example, the operator may slide protrusion 714 into indentation 706, and then slide protrusion 716 into indentation 704. Alternately, the operator may slide protrusion 716 into indentation 704, and then slide protrusion 712 into indentation 706. Indentations 704 and 706 may be a hollow tube, such as tube 718, containing a plate, such as plate 720, and a spring, such as spring 722. Spring 722 exerts pressure on plate 720 in tube 718 to keep hoop 710 in place horizontally. Lip 708 is used to position hoop 710 vertically. Of course, those versed in the art will appreciate that in one embodiment, indentations 704 and 706 may be hollow tubes, and protrusions 714 and 716 may contain springs, so that protrusions 714 and 716 may be compressed, placed into indentations 704 and 706, and then released to hold hoop 710 in place. In this example, indentations 704 and 706, and protrusions 712 and 714 are shown as being rectangular. Those versed in the art will appreciate that indentations 704 and 706, and protrusions 712 and 714 may also have different geometric shapes other than a rectangle, such as a circle, hexagon, and octagon. In one embodiment, one or both of indentation 704 and 706, and protrusions 714 and 716 may contain magnets.

Figure 8:
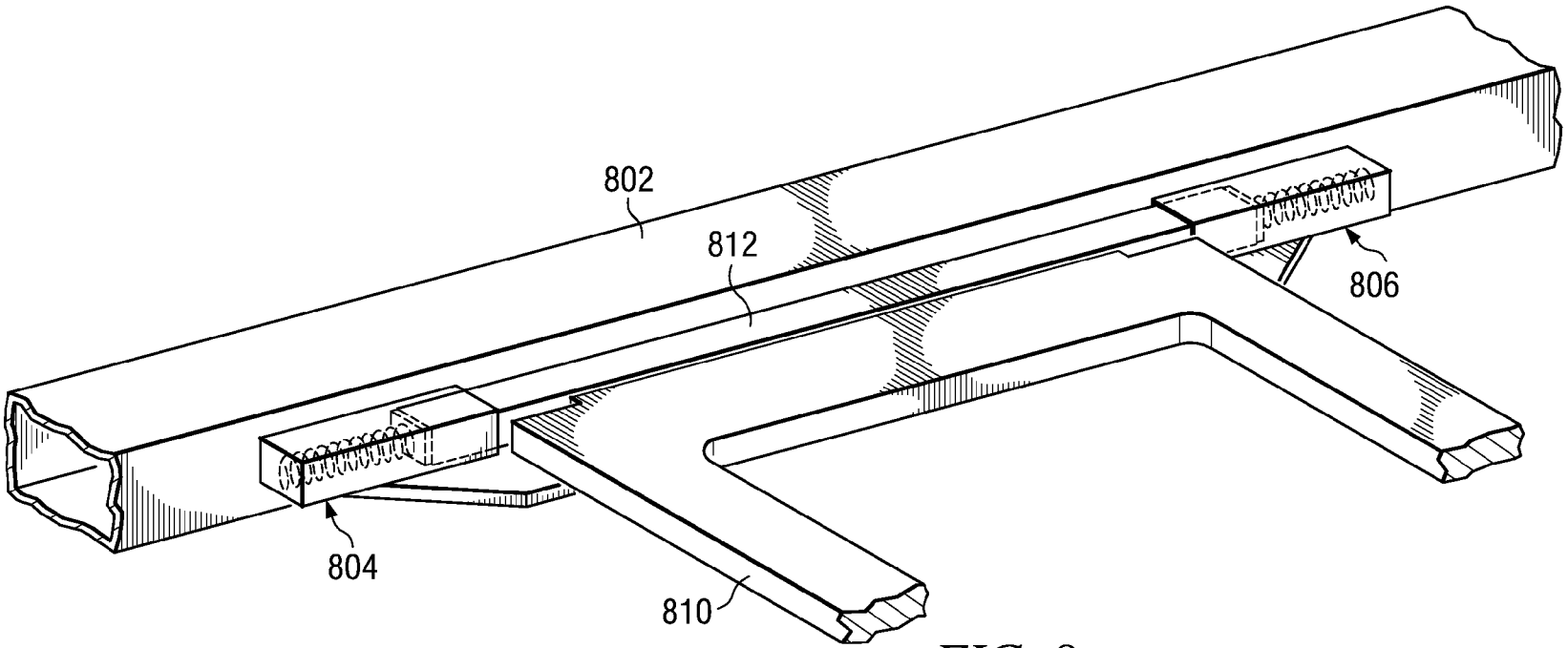
FIG. 8 illustrates a metallic hoop attached to a backrail in accordance with the illustrative embodiments.

FIG. 8 illustrates a metallic hoop attached to a backrail in accordance with the illustrative embodiments. Metallic hoop attached to a backrail illustrates a metallic hoop, such as hoop 810, after the metallic hoop has been attached to backrail 802. Backrail 802 is connected to a pantograph on an embroidery machine. The protrusions on adapter 812, such as protrusions 814 and 816 are not seen in FIG. 8 because they are inside indentations 804 and 806, respectively.

Figure 9:
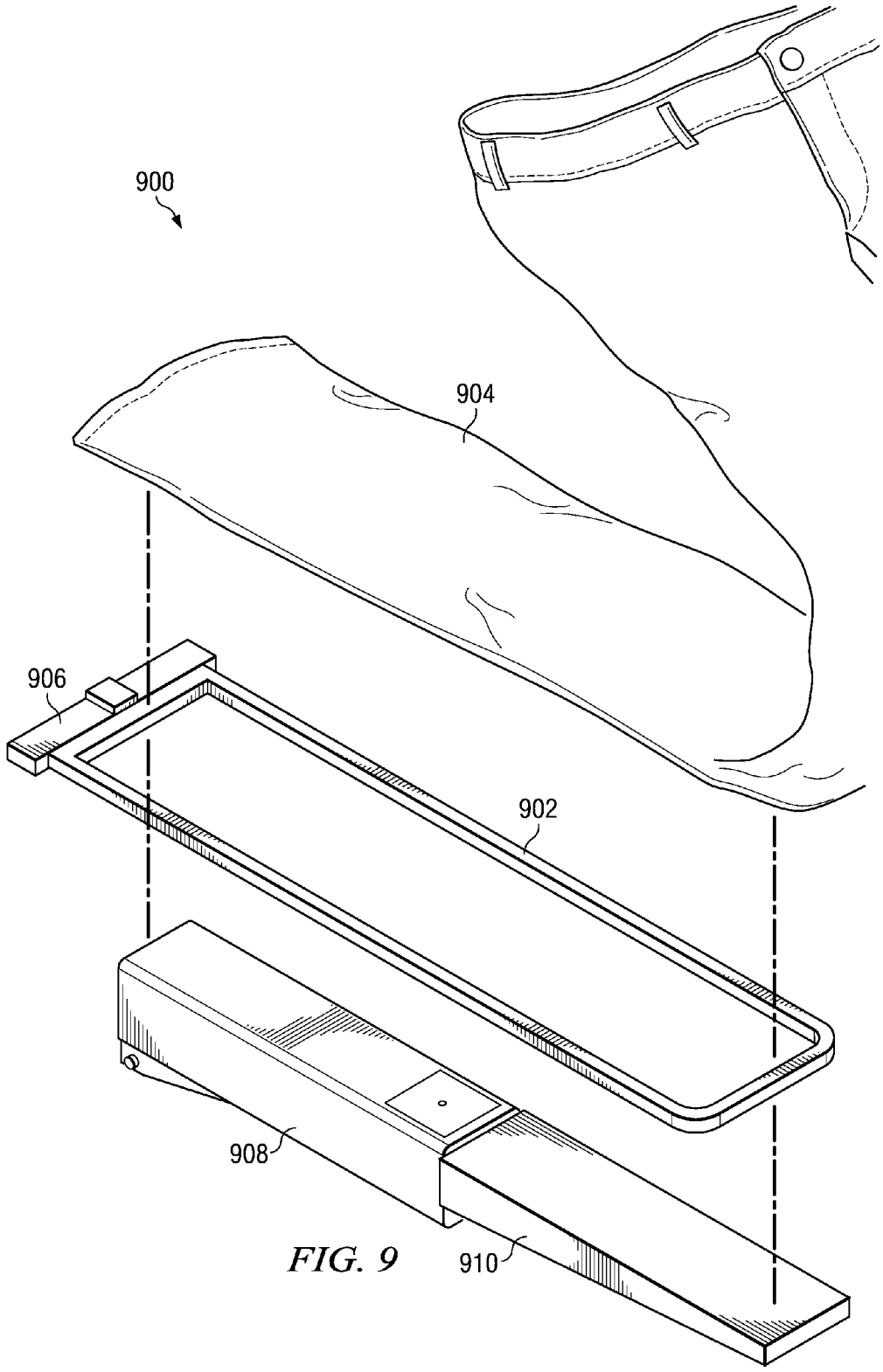
FIG. 9 illustrates a first sewing arm extension in accordance with an illustrative embodiment.

FIG. 9 illustrates a first sewing arm extension in accordance with an illustrative embodiment. In first sewing arm extension 900, hoop 902 is a metallic hoop, such as hoop 502 in FIG. 5. Embroiderable 904 is an embroiderable, such as embroiderable 118 in FIG. 1A. In this example, embroiderable 904 is a pant, and the embroidery machine operator uses hoop 902 to hoop and embroider a pant leg of pant 904. To accommodate a long embroiderable, such as, for example, a pant leg, hoop 902 has a long and narrow form.

Hoop 902 is attached to a pantograph, such as pantograph 106 in FIGS. 1A and 1B, using adapter 906. Adapter 906 is an adapter, such as adapter 510 in FIG. 5. After placing embroiderable 904 on hoop 902, an embroidery pattern is embroidered on embroiderable 904. Attached to a pantograph of an embroidery machine is sewing arm 908. Sewing arm 908 is a sewing arm, such as sewing arm 120 in FIGS. 1A and 1B. When a hoop, such as hoop 902, has a long form to accommodate a long embroiderable, such as a pant leg, hoop 902 may droop, because hoop 902 is attached to a pantograph using only adapter 906.

When embroidering a long embroiderable, such as a pant leg, using a hoop which is long in form, extension 910 is attached to sewing arm 908 to support hoop 902. Extension 910 provides support for the portion of hoop 902 farthest from adapter 906, and support for embroiderable 904. Thus, extension 910 is an optional attachment to the sewing arm of an embroidery machine. Extension 910 is typically used when a hoop, such as hoop 902, which is long in form, is used with a long embroiderable, such as a pant leg of embroiderable 904. Extension 910 may be attached to sewing 908 using a variety of means, such as, for example, mechanical and magnetic means for attaching.

Figure 10:
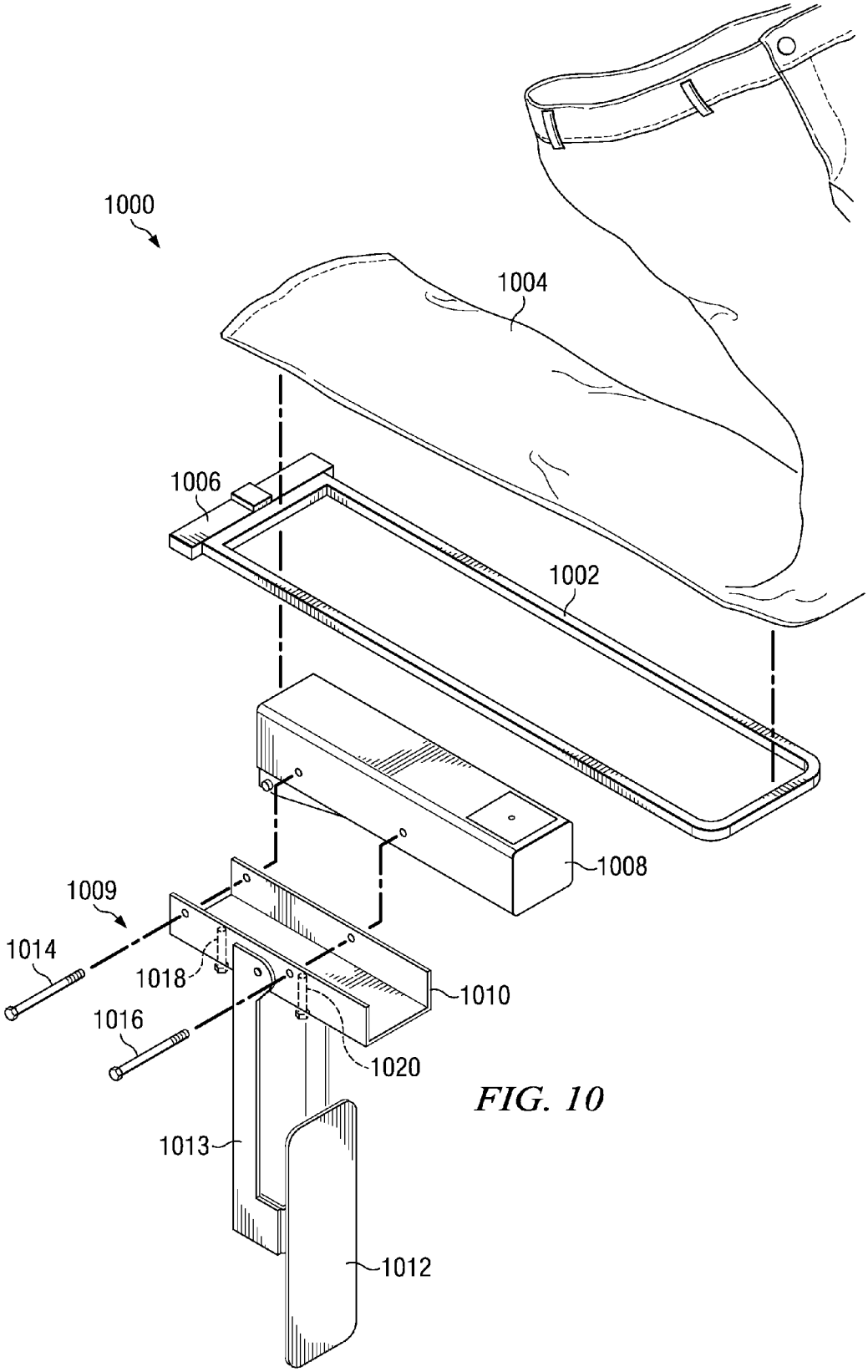
FIG. 10 illustrates a second sewing arm extension in accordance with an illustrative embodiment.

FIG. 10 illustrates a second sewing arm extension in accordance with an illustrative embodiment. In second sewing arm extension 1000, hoop 1002 is a metallic hoop, such as hoop 502 in FIG. 5, for embroidering an embroiderable, such as, embroiderable 1004. In this example, embroiderable 1004 is a pant, and hoop 1002 has a long form for embroidering a long embroiderable, such as, for example, a pant leg. Sewing arm 1008 is a sewing arm, such as sewing arm 908 in FIG. 9. Sewing arm 1008 is attached to a pantograph on an embroidery machine.

Extender 1009 is used to provide support for a long embroiderable, such as a pant leg, which uses a hoop with a long form, such as hoop 1002. Trough 1010 of extender 1009 is slipped under sewing arm 1008, so that sewing arm 1008 is encompassed below, and on two sides by trough 1010. Extension 1012 is attached to trough 1010 using swing arm 1013. Swing arm 1013 is attached to trough 1010 using a hinge mechanism, allowing extension 1012 to be swung up and down. Extender 1009 allows an embroidery machine operator to embroider embroiderables with a short form with extension 1012. When the embroidery machine operator embroiders an embroiderable with a long form, the embroidery machine operator uses swing arm 1013 to swing extension 1012 in place to support hoop 1002. Swing arm 1013 may contain a magnet which is attracted to a metal plate on trough 1010, holding extension 1012 in place. Thus, an embroidery machine operator can swing extension 1012 up and down using swing arm 1013, allowing the embroidery machine operator to quickly change from embroidering a long embroiderable to a shorter embroiderable. Trough 1010 may be attached to sewing arm 1008 using bolts 1014 and 1016. Screws 1018 and 1020 may be used to adjust the height of extender 1009.

Figure 11:
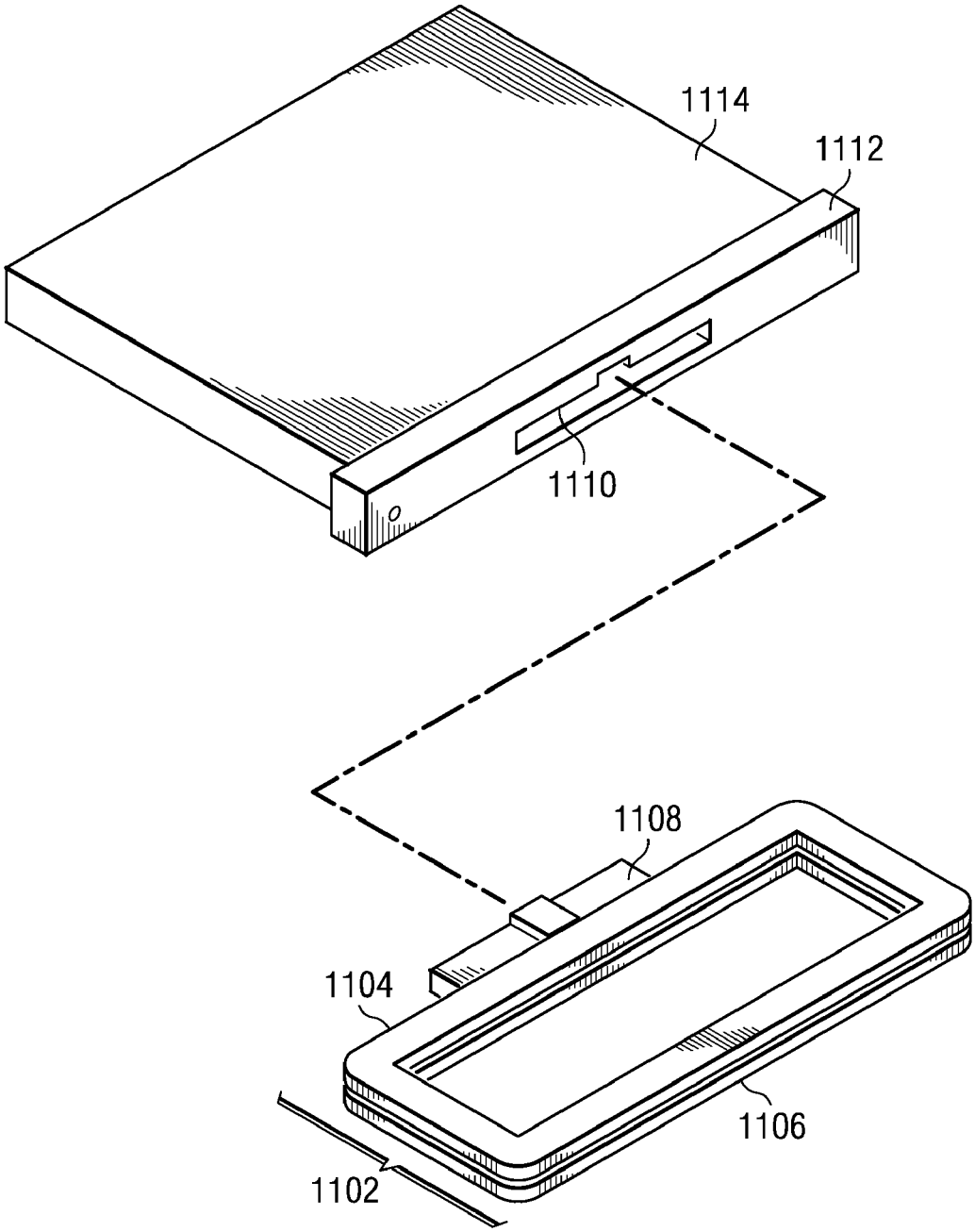
FIG. 11 illustrates a magnetic hoop assembly for embroidery in accordance with the illustrative embodiments.

FIG. 11 illustrates a magnetic hoop assembly for embroidery in accordance with the illustrative embodiments. Magnetic hoop assembly 1102 comprises two hoop components—magnetic hoop 1104 and metallic hoop 1106. In this example, magnetic hoop 1104 and metallic hoop 1106 in magnetic hoop assembly 1102 are both shown as being rectangular in shape. Those versed in the art will appreciate that magnetic hoop 1104 and metallic hoop 1106 may be created in a variety of shapes and sizes (e.g., square, circular, elliptical, or triangular, among others) for use with different types of embroiderables.

Figure 12:
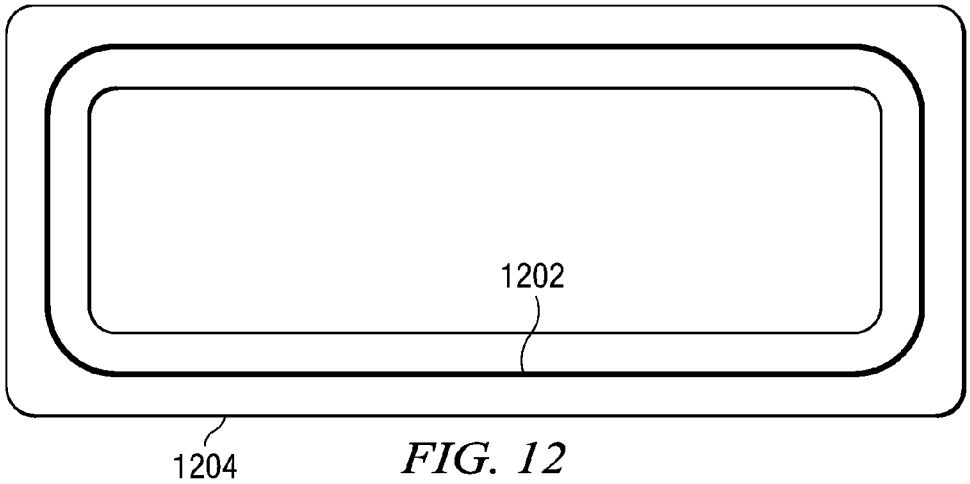
FIG. 12 illustrates an exemplary view of the magnetic hoop.
Figure 13:
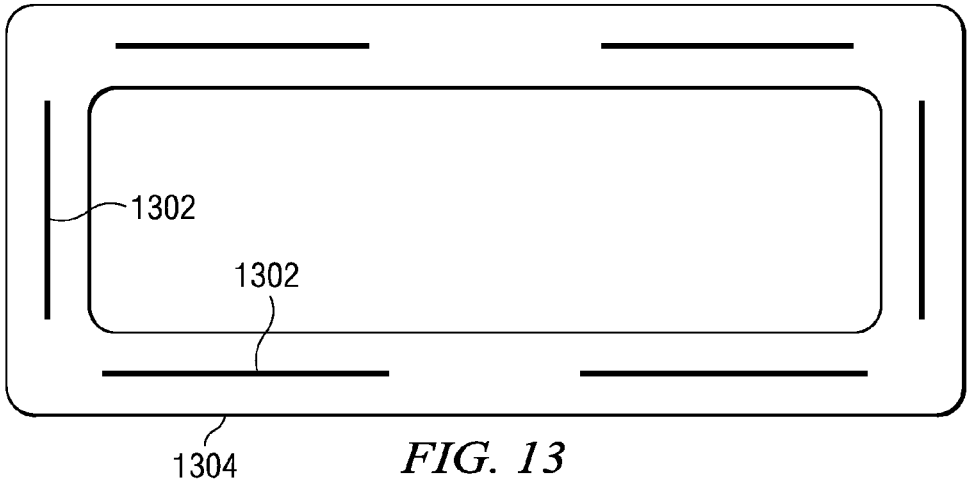
FIG. 13 illustrates an exemplary view of the magnetic hoop.

Magnetic hoop 1104 is a hoop structure comprising magnetic material embedded within the structure. In one embodiment, magnetic hoop 1104 is composed of the magnetic material combined with any of a variety of secondary non-magnetic materials, such as plastic, wood, or any combination thereof. The magnetic material embedded within magnetic hoop 1104 in this embodiment may be evenly distributed throughout the secondary material in magnetic hoop 1104. An example of a magnetic material evenly distributed throughout the secondary material in magnetic hoop 1104 is shown in FIG. 12. FIG. 12 illustrates an exemplary view of magnetic hoop 1104 in FIG. 11. As shown, magnetic material 1202 is disposed in magnetic hoop 1204 for the entire circumference of the structure. The magnetic material 1202 may be disposed on the perimeter of the secondary material hoop structure such that the magnetic material is exposed as a surface of magnetic hoop 1204, or alternatively, magnetic material 1202 may be enclosed entirely within the secondary material. The magnetic material embedded within magnetic hoop 1104 in this embodiment may, on the other hand, be located only within specific areas of magnetic hoop 1104 which is shown in FIG. 13. FIG. 13 illustrates an exemplary view of magnetic hoop 1104 in FIG. 11. As shown, magnetic material 1302 is disposed in magnetic hoop 1304 in segments along the length of the sides of the hoop structure. While the magnetic material is shown disposed in particular sections of the hoop structure, it should be noted that the invention is not limited to any particular placements, but instead may be placed in any position within the hoop structure advantageous to the placement function of the hoop assembly. In another embodiment, magnetic hoop 1104 in FIG. 11 is composed entirely of the magnetic material without any the addition of any secondary non-magnetic materials.

Metallic hoop 1106 is a hoop structure comprising a metal body. The metal body of metallic hoop 1106 contains a quantity of metal sufficient for the magnetic material embodied within magnetic hoop 1104 to be attracted to the metal in metallic hoop 1106. Those versed in the art will appreciate that metallic hoop 1106 may be created in a number of different ways. For example, in one embodiment, metallic hoop 1106 may be made entirely from metal. Alternately, in another embodiment, metallic hoop 1106 may be created using both metallic and non-metallic substances.

In a preferred embodiment, metallic hoop 1106 is constructed having the same shape and size of magnetic hoop 1104. However, metallic hoop 1106 may comprise any other shape and size as long as the magnetic attraction between metallic hoop 1106 and magnetic hoop 1104 is adequate enough to adequately hold and secure an embroiderable. Metallic hoop 1106 may also be hingedly coupled to magnetic hoop 1104. This coupling enables the separate hoop components to be maintained as a unit while still allowing the hoop components to still be separated for insertion of an embroiderable between the components and quickly joined again in a proper positioning of the hoop components in relation to one another.

Adapter 1108 adapts magnetic hoop assembly 1102 for use with a specific embroidery machine by allowing adapter 1108 to attach to the backrail of a pantograph using attachment mechanism 1110. Adapter 1108 may be attached to magnetic hoop 1104 or metallic hoop 1106. In this illustrative example, adapter 1108 is attached to metallic hoop 1106. Adapter 1108 may be contiguous with the structure of either magnetic hoop 1104 or metallic hoop 1106, or adapter 1108 may be a separate structure that is coupled to magnetic hoop 1104 or metallic hoop 1106. If adapter 1108 is a separate structure, adapter 1108 may be bolted, screwed, welded, glued, or hinged to magnetic hoop 1104 or metallic hoop 1106. Adapter 1108 and magnetic hoop 1104 or metallic hoop 1106 may have complementary interlocking structures such that adapter 1108 may be snapped onto magnetic hoop 1104 or metallic hoop 1106. In one embodiment, adapter 1108 may be coupled to magnetic hoop 1104 or metallic hoop 1106 using magnetic coupling mechanisms as described in U.S. patent application Ser. No. 11/851,926, titled "Apparatus And Method For Coupling An Embroidery Accessory To An Embroidery Machine."

Attachment mechanism 1110 is part of backrail 1112. Backrail 1112 is part of pantograph 1114. Pantograph 1114 is a pantograph in an embroidery machine, such as pantograph 106 in FIGS. 1A and 1B. Backrail 1112 is the portion of the pantograph below the embroidery head, such as head 104 in FIGS. 1A and 1B. Attachment mechanism 1110 may vary from one embroidery machine to another embroidery machine because of factors, such as, for example, the manufacturer of the embroidery machine. Adapter 1108 is designed to attach to a specific type of attachment mechanism 1110. Adapter 1108 may vary depending on the type of attachment mechanism 1110 on backrail 1112 of the embroidery machine. For example, if attachment mechanism 1110 is a "T" shaped slot in backrail 1112, adapter 1108 may contain a "T" shape which slides into the slot in backrail 1112. Alternately, adapter 1108 may have two flanges, such as flanges 208 and 210 in FIG. 2, for attaching magnetic hoop assembly 1102 to two arms, such as arms 108 and 110 in FIGS. 1A and 1B, of an embroidery machine. Thus, those versed in the art will appreciate that adapter 1108 is designed to accommodate one or more of the various attachment mechanisms available so that magnetic hoop assembly 1102 may be used with any type or size of embroidery machine.

Figure 14:
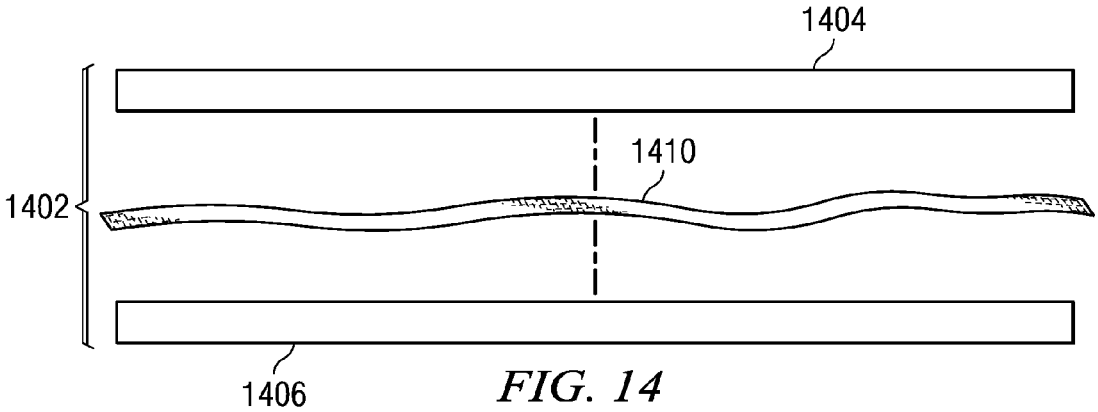
FIG. 14 illustrates preparing an embroiderable using a magnetic hoop assembly in accordance with the illustrative embodiments.

FIG. 14 illustrates preparing an embroiderable using a magnetic hoop assembly in accordance with the illustrative embodiments. In preparing an embroiderable using a magnetic hoop assembly, magnetic hoop assembly 1402 is a hoop structure comprising a magnetic hoop 1404 and a metallic hoop 1406 having sufficient metal for the magnetic material embodied within magnetic hoop 1404 to be attracted to the metal in metallic hoop 1406. An adapter such as adapter 1108 in FIG. 11 adapts magnetic hoop assembly 1402 for use with a specific embroidery machine by allowing the adapter to attach to the backrail of a pantograph. When magnetic hoop assembly 1402 is attached to the embroidery machine, the operator may place embroiderable 1410 on top of metallic hoop 1406. The operator then places magnetic hoop 1404 on top of embroiderable 1410. The magnetic material in magnetic hoop 1404 has an attraction to the metal in metallic hoop 1406, and the attraction holds embroiderable 1410 in place on metallic hoop 1406.

The illustrative embodiments described herein provide a placement holder for an embroiderable. In one embodiment, the placement holder for an embroiderable comprises a magnetic hoop assembly for use in an embroidery machine. The magnetic hoop assembly comprises two hoop components—a first hoop comprising magnetic material throughout the hoop, and a second hoop with a quantity of metal sufficient for the magnetic material in the first hoop to be attracted to the metal in the second hoop. An embroiderable may be placed directly between the first and second hoops for embroidery. An adapter is attached to the one of the hoops in the magnetic hoop assembly. One end of the adapter is attached to at least a portion of the magnetic hoop assembly, and the other end of the adapter attaches to an attachment mechanism on a pantograph on the embroidery machine. In another embodiment, the placement holder comprises a single metallic hoop system for use in an embroidery machine. The metallic hoop contains a quantity of metal sufficient for a magnet to be attracted to the metallic hoop. A backing and the embroiderable are placed on top of the metallic hoop for embroidery. An adapter is attached to the metallic hoop. One end of the adapter is attached to the metallic hoop, and the other end of the adapter attaches to an attachment mechanism on a pantograph on the embroidery machine.

There are several advantages to using the magnetic hoop assembly or the single metallic hoop system over conventional systems such as a frame and adhesive, a clamping device, an embroidery hoop, or a metal plate inside an embroidery hoop with a window and magnets. Unlike the frame and adhesive shown in FIG. 1A, using the magnetic hoop assembly or the single metallic hoop system allows the operator of the embroidery machine to avoid using adhesive, which may get on the embroidery machine or embroiderable. The attraction of the magnets to the metallic hoop or the attraction of the magnetic hoop component to the metal hoop component does not cause burn marks or fabric degradation when using delicate fabrics, unlike the clamping device shown in FIG. 2.

The magnetic hoop assembly and the single metallic hoop system are superior to the traditional two-piece hoop for several reasons. A traditional two-piece hoop, such as the one depicted in FIGS. 3A-3B, requires the two hoops to be snapped together with the backing placed in between the two hoops. Depending on the thickness of the backing, an embroidery machine operator may find snapping the two hoops together and pulling them apart to be physically challenging. With the magnetic hoop assembly and the single metallic hoop system, the operator may avoid having to snap together and pull part the two traditional hoops, reducing the time needed to place and position the embroiderable for embroidery. In addition, since a traditional two-piece hoop must be snapped together, a traditional two-piece hoop often cannot be used for very thick embroiderables, while the magnetic hoop assembly and the single metallic hoop system can accommodate such embroiderables, including thick quilting materials. Furthermore, the embroiderable may be placed directly between the first and second hoops for embroidery as the magnetic hoop assembly and the single metallic hoop system do not require the use of backing or stabilizer material.

The magnetic hoop assembly and the single metallic hoop system also have advantages over the metal plate and embroidery hoop system depicted in FIG. 4. Using a metal plate with a traditional embroidery hoop still requires the operator to snap together and pull part the two traditional embroidery hoops. The magnetic hoop assembly and the single metallic hoop system also uses fewer parts that the metal plate and traditional embroidery hoop system, since the metal plate and embroidery hoop system adds the metal plate, positioning device, and magnets to the process of positioning the embroiderable. The magnetic hoop assembly replaces the two traditional hoops and the metal plate with a magnetic hoop and a metallic hoop, thereby using fewer parts and enabling the operator to position the embroiderable faster. Likewise, the single metallic hoop system replaces the two traditional hoops and the metal plate with one metallic hoop, thereby using fewer parts. Moreover, the operator has to keep track of fewer parts when changing embroiderables. In addition, long embroiderables such as pant legs, or shirt sleeves, which may be difficult or impossible to hold in place on an embroidery machine using conventional means, may be positioned and held in place using the magnetic hoop assembly or the single metallic hoop system. Moreover, while the metal plate with a traditional embroidery hoop system requires the use of backing or stabilizer material to hold the metal plate and positioning device in place, the magnetic hoop assembly and the single metallic hoop system allow the embroiderable to be placed directly between the first and second hoops for embroidery, as the magnetic hoop assembly or the single metallic hoop system does not require the use of backing or stabilizer material. In addition, unlike the metal plate with a traditional embroidery hoop system, the magnetic hoop assembly does not reduce the size of the embroiderable area. Placement of the metal plate and positioning device reduces the scope of the embroiderable area down from the original area provided by the traditional embroidery hoop. As the magnetic hoop assembly holds and positions the embroiderable using only the magnetic hoop and the metallic hoop and the magnetic hoop and the metallic hoop are the same in shape and size, the full scope of the embroiderable area provided by the metallic hoop is not diminished by the magnetic hoop, but rather the scope is maintained.

The frame and hoop are attached to an embroidery machine using the two arms on the embroidery machine. Therefore, all the conventional methods of positioning and holding the embroiderable require that the embroidery machine have arms attached. However, the illustrative embodiments do not specifically require that the embroidery machine have arms. If the embroidery machine has arms, the magnetic hoop assembly or the single metallic hoop structure may be mounted using an appropriate adapter. If the embroidery machine does not have arms, the magnetic hoop assembly or the single metallic hoop structure may be attached to the embroidery machine using an adapter appropriate for the attachment mechanism on the embroidery machine.

What is claimed is:

1. A placement holder for an embroiderable comprising:

a first hoop for use in an embroidery machine, wherein the first hoop comprises a magnetic material and a non-magnetic material, the magnetic material at least partially embedded within the non-magnetic material;

a second hoop for use in the embroidery machine, wherein the second hoop comprises a quantity of metal sufficient for the first hoop to be attracted to the second hoop, wherein magnetic attraction between the first hoop and the second hoop enables the embroiderable to be held in place between the first hoop and the second hoop for embroidery, wherein the second hoop is separable from the first hoop at least when the second hoop is magnetically disengaged from the first hoop, and wherein at least one of the first hoop or the second hoop is adapted to be coupled to the embroidery machine.

2. The placement holder of claim 1, wherein the second hoop comprises both metal and non-metal materials.

3. The placement holder of claim 1, wherein the magnetic material is located on a perimeter of the first hoop.

4. The placement holder of claim 1, wherein the magnetic material is evenly distributed throughout the first hoop.

5. The placement holder of claim 1, wherein the magnetic material is located in segments in the first hoop.

6. The placement holder of claim 1, wherein the first hoop comprises a same size and shape as the second hoop to maintain a scope of embroiderable area provided by the second hoop.

7. The placement holder of claim 1, further comprising:

an adapter coupled to at least one of the first hoop or second hoop, wherein one end of the adapter is coupled to at least one of the first hoop or second hoop and the other end of the adapter is attachable to an attachment mechanism on the embroidery machine, wherein the adapter comprises one or more protrusions, and wherein the one or more protrusions on the adapter mate with one or more corresponding indentations on the attachment mechanism to attach the at least one of the first hoop or the second hoop to the embroidery machine.

8. The placement holder of claim 1, further comprising:

an adapter coupled to at least one of the first hoop or second hoop, wherein one end of the adapter is coupled to at least one of the first hoop or second hoop and the other end of the adapter is attachable to an attachment mechanism on the embroidery machine, wherein the adapter comprises one or more magnets, and wherein the one or more magnets on the adapter are attracted to the attachment mechanism to attach the at least one of the first hoop or the second hoop to the embroidery machine.

9. The placement holder of claim 1, wherein the second hoop is non-hingeably engageable to the first hoop.

10. The placement holder of claim 1, wherein the first hoop and the second hoop each has a rectangular shape and a rectangular aperture.

11. The placement holder of claim 1, wherein the first hoop has an inward-facing surface adapted to face the second hoop when the first and second hoops are magnetically engaged, the inward-facing surface of the first hoop approximating a fat surface; and wherein the second hoop has an inward-facing surface adapted to face the first hoop when the first and second hoops are magnetically engaged, the inward-facing surface of the second hoop approximating a flat surface.

12. The placement holder of claim 1, wherein the magnetic material has an inward-facing surface adapted to face the second hoop when the first and second hoops are magnetically engaged, the inward-facing surface of the magnetic material being exposed at least when the first hoop is magnetically disengaged from the second hoop.

13. The placement holder of claim 1, wherein the first hoop is in a non-touching relationship with the second hoop when the second hoop is separated from the first hoop.

14. The placement holder of claim 1, wherein the non-magnetic material comprises plastic.

15. The placement holder of claim 1, wherein the magnetic material is encased entirely within the non-magnetic material.

16. A placement holder for an embroiderable comprising:

a metallic hoop for use in an embroidery machine, wherein the metallic hoop comprises a quantity of metal sufficient for a magnet to be attracted to the metallic hoop, and wherein an embroiderable is placeable on the metallic hoop; and a magnetic hoop comprising one or more magnets adapted to magnetically engage the metallic hoop, the magnetic hoop comprising a non-magnetic material, the one or more magnets at least partially embedded within the non-magnetic material, the embroiderable secureable between the metallic hoop and the magnetic hoop when the magnetic hoop is magnetically engaged to the metallic hoop, the magnetic hoop disconnectable from the metallic hoop at least when the magnetic hoop is magnetically disengaged from the metallic hoop, wherein at least one of the magnetic hoop or the metallic hoop is adapted to be coupled to the embroidery machine.

17. The placement holder of claim 16, wherein the magnetic hoop is a positioning template containing a window for positioning the embroiderable.

18. The placement holder of claim 16, wherein the magnetic hoop is adapted to be separated from the metallic hoop by the embroiderable while the magnetic hoop is magnetically engaged to the metallic hoop.

19. A placement holder adapted to coupled to an embroidery machine, the placement holder comprising:

a first hoop comprising a plurality of magnets, the first hoop having a substantially rectangular shape and a substantially rectangular aperture, the first hoop comprising both magnetic material and non-magnetic material, the plurality of magnets at least partially encased within the non-magnetic material, the plurality of magnets located in segments in the first hoop such that the plurality of magnets are spaced apart from one another;

a second hoop comprising metal and having a substantially rectangular shape and a substantially rectangular aperture, the second hoop adapted to be magnetically engaged to the first hoop to secure an embroiderable, the first hoop separable from the second hoop at least when the first hoop is magnetically disengaged from the second hoop such that the first hoop is in a non-touching relationship with the second hoop; and an adapter coupled to at least one of the first hoop or second hoop, wherein one end of the adapter is coupled to at least one of the first hoop or second hoop and the other end of the adapter is attachable to an attachment mechanism on the embroidery machine.

20. The placement holder of claim 19, wherein the first hoop has a substantially square shape and a substantially square aperture, and wherein the second hoop has a substantially square shape and a substantially square aperture.

* * * * *